United States Patent [19]

Capuano et al.

[11] 4,230,486

[45] Oct. 28, 1980

[54] PROCESS FOR REMOVAL AND RECOVERY OF MERCURY FROM LIQUIDS

[75] Inventors: Italo A. Capuano; Patricia A. Turley, both of Orange, Conn.

[73] Assignee: Olin Corporation, New Haven, Conn.

[21] Appl. No.: 901,175

[22] Filed: Apr. 28, 1978

[51] Int. Cl.[2] ..... C22B 43/00

[52] U.S. Cl. ..... 75/81; 75/121; 423/99; 423/180

[58] Field of Search ..... 75/109, 121, 101 R, 75/81; 423/99, 107, 109, 180

[56] References Cited

U.S. PATENT DOCUMENTS

| | | | |
|---|---|---|---|
| 2,266,475 | 12/1941 | Ramsay | 75/81 |
| 2,837,408 | 6/1958 | Sakowski | 423/180 |
| 3,502,434 | 3/1970 | MacMillan | 75/81 |
| 3,512,220 | 5/1970 | Hund et al. | 423/180 |
| 3,704,875 | 12/1972 | Waltrich | 75/81 |
| 3,847,598 | 11/1974 | Coulter et al. | 423/107 |
| 3,849,533 | 11/1974 | Hetz | 423/99 |
| 3,940,614 | 2/1976 | Rhodes et al. | 250/273 |
| 4,059,438 | 11/1977 | Müller | 75/81 |

OTHER PUBLICATIONS

*European Chemical News,* Aug. 4, 1972, p. 22, "Uhde Details Chlorine Cell Mercury Recovery Process".

*Primary Examiner*—L. Dewayne Rutledge
*Assistant Examiner*—Peter K. Skiff
*Attorney, Agent, or Firm*—James B. Haglind; Donald F. Clements

[57] ABSTRACT

A method is presented for recovering mercury from mercury-containing liquids in which the liquids are contacted with particles of metallic silver. The method produces highly purified liquids which may be employed in applications having a low mercury tolerance such as the production of food or drug products.

27 Claims, 1 Drawing Figure

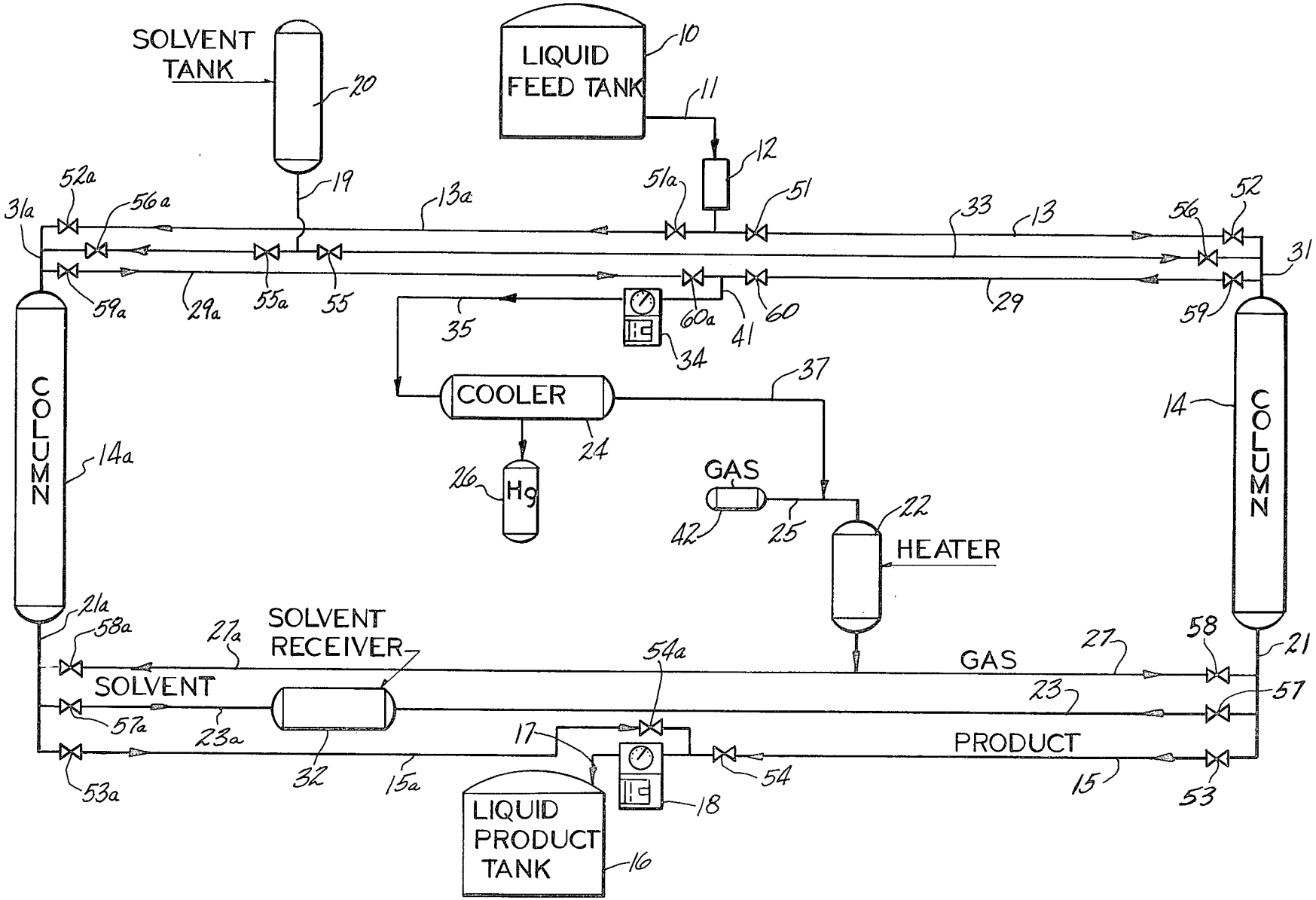
NECTON
NECTON
LIQUID FEED TANK
SOLVENT TANK
COOLER
HEATER
GAS
GAS
PRODUCT
LIQUID PRODUCT TANK
SOLVENT RECEIVER
SOLVENT
Hg
Hg

PROCESS FOR REMOVAL AND RECOVERY OF MERCURY FROM LIQUIDS

This invention relates to the removal and recovery of mercury from liquids. More particularly, this invention is related to the removal and recovery of mercury from liquids used in the production of foods and drugs.

Chemical compounds such as alkali metal methylates, alkali metal hydroxides and alkali metal hydrosulfites can be produced commercially in processes employing an alkali metal amalgam as a reactant. The processes for manufacturing treat solutions of these products normally with an agent such as activated carbon to remove a substantial portion of the mercury present. Where, however, it is desired to use these product solutions in applications having a low mercury tolerance such as the preparation of food or drug products, or the processing of photographic film, it is necessary to reduce the mercury concentration to very low levels.

It is an object of the present invention to provide a method of effectively removing mercury from liquids.

Another object of the present invention is to provide a method of recovering mercury in the production of highly purified solutions.

These and other objects of the invention are accomplished in a process for the recovery of metallic mercury from a mercury-containing liquid having a pH of about 5 or higher which comprises:

(a) contacting particles of metallic silver with the liquid to dissolve the mercury in the metallic silver to form a silver amalgam and a purified liquid, (b) separating the purified liquid from the silver amalgam, (c) heating the silver amalgam with a heated gas to vaporize mercury from the silver amalgam to produce mercury vapors and particles of metallic silver, the heated gas containing the mercury vapors, (d) cooling the heated gas to condense the mercury vapors to metallic mercury, and (e) recovering the metallic mercury.

The process of the present invention may be used to remove mercury from liquids including those which can be produced using a mercury-containing reactant such as an alkali metal or alkaline earth metal amalgam. Suitably treated are solutions of compounds such as alkali metal or alkaline earth metal alcoholates, alkali metal or alkaline earth metal hydroxides and alkali metal hydrosulfites.

The accompanying FIGURE illustrates a schematic diagram of the novel process of the present invention. As shown in the schematic diagram of the FIGURE, the mercury containing liquid is removed from liquid feed tank 10 through line 11 and passes through filter 12 to remove any filterable solids present in the liquid. From filter 12, the liquid flows through valve 51 to line 13, valve 52 to line 31 and into column 14. Column 14 contains the metallic silver packing. Upon flowing through the silver packing, metallic mercury in the liquid is dissolved into the silver present to form a silver amalgam. The purified liquid flows from column 14 through line 21, valve 53 to line 15 and valve 54 to liquid monitor 18. Liquid monitor 18 analyzes the purified liquid for its mercury content. Following the analysis in liquid monitor 18, the purified liquid flows through line 17 to liquid product tank 16.

Should liquid monitor 18 indicate that the mercury concentration in the purified liquid product is above the desired concentration range, valves 51 and 52 are closed and valves **51*a* and 52*a* opened. This permits the liquid from liquid feed tank 10 to flow through alternate column 14*a*** for purification and permits the process to be run continuously.

Mercury may be recovered and the silver particles rejuvenated by treating the amalgamated particles. Mercury recovery can be accomplished by the process illustrated by the FIGURE in which column 14, containing the amalgamated silver particles is first flushed with a solvent. The solvent flows from solvent tank 20 through line 19, valve 55, line 33, and valve 56 to line 31 where it is fed to column 14. The solvent dissolves or removes salts deposited on the packing and removes any alkaline solution remaining in column 14. The solution is removed from column 14 through line 21, valve 57, line 23 to solvent receiver 32. From solvent receiver 32, the solvent can be recycled, for example, to the reactor in which the neutral or alkaline liquid is produced. A non-reactive gas such as nitrogen is fed from tank 42 through line 25 to heater 22 where the gas is heated to a temperature sufficiently high to vaporize the mercury from the silver amalgam present in column 14. The heated gas is passed through line 27, valve 58 and line 21 to column 14 to heat the amalgamated particles and to vaporize mercury from the silver amalgam. The heated gas containing mercury vapors leaves column 14 through line 31 and passes through valve 59, line 29 and valve 60 into line 41 to gas monitor 34. Gas monitor 34 analyzes the heated gas for its mercury content. From gas monitor 34, the heated gas passes through line 35 to cooler 24. Cooler 24 cools the gas to condense the mercury in the vapor as liquid mercury. Liquid mercury flows from cooler 24 to mercury container 26. Cooled gas, substantially depleted of mercury is preferably recycled to gas heater 22 through line 37.

The novel process of the present invention is capable of reducing the metallic mercury content of liquids to a level which permits their use in applications which are mercury sensitive, for example, in the production of food products or drug products. Suitable amounts of mercury in liquids employed in these applications are concentrations below about 1,000, preferably below about 200 and more preferably below about 50 parts per billion of mercury.

To accomplish this mercury removal, the mercury-containing liquids are contacted with metallic silver or gold to dissolve the mercury present in the solution to form an amalgam. To simplify the disclosure, it will be described in terms of metallic silver, a preferred embodiment. To provide adequate contact with the liquid, the silver is preferably in particulate form, for example, as silver powder or silver granules or particles of carriers on which silver is coated or deposited. Carriers which can be used to support the silver coating are materials which do not react with mercury, silver, or the liquid, are thermally stable and can be coated with silver. Suitable carriers include, for example, active carbon, ceramic materials such as glass, brick, refractories, abrasives and porcelain. Particle sizes in the range of from about 27,000 to about 30, preferably from about 11,000 to about 150 and more preferably from about 3,400 to about 500 microns are employed.

Also suitably used are mixtures of silver granules or silver coated particles with non-coated particles of carriers such as active carbon.

Where particles of carriers coated with silver or mixtures are employed, it is desirable to maintain the silver content of the particles in the range of from about 0.5 to about 90, preferably from about 5 to about 60 and more preferably from about 10 to about 50 percent by weight of the particle. This can be achieved, for example, by providing a coating on the carrier particle which is sufficiently thick to provide the desired amounts of silver or by admixing silver coated particles with silver powder or silver granules.

To provide adequate contact between the liquids containing mercury and the silver particles, the particles are employed, for instance, in a bed or as packing in a separation unit. Packed columns or fluid beds are suitable separation units. The liquids, at a pH of about 5 or higher, flow through the bed or column and mercury present in the liquid dissolves into the silver to form an amalgam. After recovery of the purified liquid, the silver amalgam produced is then washed with an appropriate solvent to remove salts and/or solutions which remain in the bed or column. For example, if the liquid is an alkali metal alkoxide such as sodium methylate, an alcohol such as methanol is a suitable solvent. Where alkali metal or alkaline earth metal hydroxides have been purified, it may be desirable to employ water as the solvent. After washing the silver amalgam particles, the solvent is removed from the separation unit and preferably recovered for re-use.

The process of the present invention can be employed with any mercury-containing liquid which does not substantially interfere with the formation of silver amalgam. For example, slightly acidic, neutral, or alkaline liquids containing metallic mercury can be treated. These liquids have a pH of about 5 or higher, preferably from about 6.5 or higher. Strong solutions of alkalies such as alkali metal hydroxides having a concentration of, for example, 50 percent by weight or greater of the alkali metal hydroxide may be suitably treated. For organic liquids or solutions in which the solvent is an organic compound, the acidity or alkalinity is that which is equivalent to aqueous solutions having a pH of about 5 or higher. The acidity or alkalinity is normally determined by procedures such as titrations. For example, a solution of 25 percent by weight of sodium methylate in methanol has a total alkali content of about 4.63 equivalents of a base such as sodium hydroxide per liter of solution.

Recovery of the mercury from the amalgam can be accomplished in any suitable manner. One method is to heat the amalgam sufficiently to vaporize the mercury. As shown in the FIGURE, this can be done by heating a non-reactive gas such as nitrogen to a temperature in the range of from about 100° to about 400° and preferably from about 200° to about 300° C. Gases which are capable of reacting with the amalgams to form silver compounds and/or mercury compounds are preferably avoided. Upon forcing the heated gas through the amalgamated particles, the mercury is released as a vapor and then transported by the gas to a suitable vessel. The heated gas may also contain small amounts of vapors of the solvent used to wash the silver amalgam particles.

Liquid mercury can be recovered by cooling the heated gas containing mercury vapors to a temperature below 100° C., preferably from about 20° to about −35° C. If necessary, the liquid mercury is separated from any solvent which has condensed during the cooling. Recovered liquid mercury can be recycled, for example, to an electrolytic cell employing a mercury cathode. The cell produces an alkali metal amalgam or alkaline earth metal amalgam which may be used as a reactant in the production of liquids suitably purified by the process of the present invention.

Solutions of products such as alkali metal or alkaline earth metal alkoxides are preferred embodiments of products which can be purified by the process of the present invention. These products may be produced by reacting an alcohol with an amalgam of the alkali metal or alkaline earth metal. Suitable alkali metals include sodium, potassium or lithium while calcium or magnesium are exemplary of the alkaline earth metals. Any alcohol which may be so reacted can be used to form the alkoxides. Suitable alcohols include primary, secondary, or tertiary alcohols, glycols, and polyols which are liquids at ambient temperatures as well as those which can be liquified upon heating. Specific examples include methanol, ethanol, dodecanol, pinacol, tert-butanol and ethylene glycol. Solutions of hydroxides such as sodium hydroxide, potassium hydroxide, lithium hydroxide, calcium hydroxide or magnesium hydroxide may be purified as well as alkali metal or alkaline earth metal hydrosulfites.

Metallic mercury in water or waste solutions, for example, where the mercury is admixed with organic or inorganic compounds may be purified providing they do not contain materials such as certain oxidizing agents which are sufficiently reactive with silver to inhibit the formation of silver amalgam.

During the liquid purification process to recover mercury, it is advantageous to analyze the liquid or heated gas containing mercury vapors for its mercury content. This can be accomplished using any known methods for mercury analysis. Suitably used as liquid monitor 18 is the apparatus and method described in U.S. Pat. No. 3,713,776, issued Jan. 30, 1973, to I. A. Capuano or that of U.S. Pat. No. 3,826,614, issued July 30, 1974, to I. A. Capuano. Mercury-containing gases can be analyzed in gas monitor 34 using the apparatus and method described in U.S. Pat. Nos. 3,713,776 or 3,826,618, issued July 30, 1974, to I. A. Capuano.

As shown in the FIGURE, the process of the present invention may be operated continuously by employing more than one separation unit which permits the liquid to be purified in one unit while a second unit is being treated to recover the mercury collected.

Liquids can be processed over a wide range of space velocities. For example, space velocities per hour of from about 0.5 to about 100, preferably from about 1 to about 60, and more preferably from about 2 to about 30, may be employed. Space velocity is defined as being the feed rate of the liquid per unit of volume of particles of metallic silver per hour.

The process may be employed to recover mercury from liquids having a wide range of temperatures and pressures.

Metallic mercury can be efficiently removed from liquids to produce products which can be used in applications which have a low tolerance for mercury. The process can also be used to provide effluents which can be safely disposed of without polluting the environment.

To further illustrate the process of the present invention, the following Examples are presented. All percentages are by weight unless otherwise specified.

EXAMPLE 1

Firebrick particles (500–1000 microns in size) having a coating of silver representing 20 percent of the particle weight were prepared. A portion of 720 grams of the coated particles was mixed with 200 grams of silver powder and the mixture added to a column (2 inch diameter) to provide a packing height of 16 inches. The silver content was 40 percent of the total weight of the mixture. Using the procedure of the FIGURE, a methanol solution containing 25 percent by weight of sodium methylate, at a temperature of 35° C., was pumped from tank 10 through column 14 at a space velocity of 6 per hour. Over a period of 15 days, the mercury content in the methylate solution leaving the tank was determined to be in the range of from 0.60 to 1.93 parts per million. Periodic analysis of the purified sodium methylate solution leaving the column determined the mercury content to be in the range of from about 12 to about 50 parts per billion of Hg.

To recover the mercury in the silver amalgam formed, the column was regenerated using the procedure illustrated in the FIGURE. Methanol was fed to the top of the column and passed downward through the packing to remove sodium methylate present. The methanol solution was drained from the bottom of the column. Hot nitrogen gas (200° C.) was fed to the bottom of the column at a rate of 1,000 parts per minute. The hot nitrogen vaporized the mercury from the silver amalgam and the mercury vapors were cooled in a cold trap to condense and recover the liquid mercury.

EXAMPLE 2

A column (1.9 inch diameter) was packed with a mixture containing 110 grams of silver powder and 435 grams of firebrick particles having a silver coating amounting to 20 percent by weight of the particles. The silver content of the mixture was 40 percent of the total weight of the packing. A sodium methylate solution in methanol (25 percent by weight of $CH_3ONa$), at a temperature of 27° C., was passed through 15 inches of the silver packing material at various flow rates. Equal volumes of solution were passed through the column at each of the space velocities employed. Mercury content of the sodium methylate solution was initially 2.9 parts per million. Analysis for mercury in the effluent solution gave the following results:

| Space Velocity (hrs.$^{-1}$) | Hg in Effluent (ppb) |
|---|---|
| 3 | 7 |
| 7 | 6 |
| 11 | 5 |
| 18 | 9 |

This example shows that mercury was effectively removed from the solution over a wide range of space velocities.

EXAMPLE 3

Activated carbon particles (1200–3400 microns) were coated with metallic silver to provide a silver content of 40 percent of the total particle weight. A column (15 inches by 1.5 inches) was packed with 200 grams of these particles. Into the column, a 25 percent solution of sodium methylate in methanol (b.p. 87° C.) was fed at a rate of 10 parts per minute. The methylate solution contained 1.8 parts per million of mercury and the temperature of the solution was initially 25° C. Over a period of time, the methylate solution was heated and the efficiency of mercury removal determined at various temperatures. The results are as follows:

| Effluent Temperature of $CH_3ONa$ | Total Hg in Effluent (ppm) | % Efficiency of Hg Removal |
|---|---|---|
| 25° C. | .197 | 89 |
| 40° C. | .079 | 96 |
| 50° C. | .032 | 98 |
| 70° C. | .022 | 99 |

The above example illustrates that the process of the present invention effectively recovers mercury from solutions at any of several temperatures.

EXAMPLE 4

Metallic mercury and water were added to a container, vigorously agitated and allowed to settle. A portion of the supernatant liquid was removed, analyzed for mercury content, and the aqueous solution was found to contain 3.4 parts per million of Hg. The solution was passed through a column 0.375 of an inch in diameter packed to a height of 3 inches with silver coated glass beads having particle sizes in the range of 150 to 175 microns. The column effluent was found to contain 10 parts per billion of mercury.

What is claimed is:

1. A process for the recovery of metallic mercury from a mercury-containing liquid having a pH of about 5 or higher to produce a purified liquid having a mercury content of less than 50 parts per billion which comprises:

(a) contacting particles of metallic silver with said liquid to dissolve said mercury in said metallic silver to form a silver amalgam and a purified liquid, (b) separating said purified liquid from said silver amalgam, (c) heating said silver amalgam with a heated gas to vaporize mercury from said silver amalgam to produce mercury vapors and particles of metallic silver, said heated gas containing said mercury vapors, (d) cooling said heated gas to condense said mercury vapors to metallic mercury, and (e) recovering said metallic mercury.

2. The process of claim 1 in which said particles of metallic silver are silver powder or silver granules.

3. The process of claim 1 in which said particles of metallic silver comprise silver coated particles of ceramic materials selected from the group consisting of glass, bricks, refractories, porcelain and abrasives.

4. The process of claim 2 or 3 in which said mercury-containing liquid is selected from the group consisting of solutions of alkali metal hydroxides, alkaline earth metal hydroxides, alkali metal alkoxides, alkaline earth metal alkoxides, and alkali metal hydrosulfites.

5. The process of claim 3 in which said particles of metallic silver are glass particles coated with metallic silver.

6. The process of claim 3 in which said liquid has a pH of from about 6.5 or higher.

7. The process of claim 6 in which said silver coated particles are admixed with silver powder or silver granules.

8. The process of claim 7 in which said ceramic material is brick.

9. The process of claim 8 in which said particles have a silver content of from about 0.5 to about 90 percent by weight of silver.

10. The process of claim 9 in which said heated gas is nitrogen at a temperature of from about 100° to about 400° C.

11. The process of claim 10 in which said particles have a size of from about 27,000 to about 30 microns.

12. The process of claim 11 in which said particles form the packing of a separation column.

13. The process of claim 12 in which said particles are contacted with said liquid at a space velocity in the range of from about 0.5 to about 100 per hour.

14. The process of claim 13 in which said liquid is a solution of an alkali metal alkoxide produced by the reaction of an alkali metal amalgam with an alcohol.

15. The process of claim 14 in which said liquid is a solution of sodium methylate.

16. The process of claim 13 in which said heated gas containing mercury vapors is cooled to a temperature below 100° C. to condense said mercury vapors to form metallic mercury.

17. The process of claim 13 in which said liquid is water.

18. A process for the recovery of metallic mercury from a solution of an alkali metal alkoxide to produce a purified solution having a mercury content of less than 50 parts per billion which comprises:

(a) contacting particles of metallic silver contained in a separation unit with said liquid to dissolve said mercury in said silver to form a silver amalgam and a purified solution of an alkali metal alkoxide, (b) separating said purified solution from said silver amalgam, (c) heating said silver amalgam with a heated gas to vaporize mercury from said silver amalgam to produce mercury vapors and particles of metallic silver, said heated gas containing said mercury vapors, (d) cooling said heated gas to condense said mercury vapors to metallic mercury, and (e) recovering said metallic mercury.

19. The process of claim 18 in which said particles of metallic silver are silver powder or silver granules.

20. The process of claim 18 in which said particles of metallic silver comprise silver coated particles of ceramic materials selected from the group consisting of glass, bricks, refractories, porcelain and abrasives.

21. The process of claim 20 in which said silver coated particles are admixed with silver powder or silver granules.

22. The process of claim 21 in which said ceramic material is brick.

23. The process of claim 22 in which said particles have a silver content of from about 5 to about 60 percent by weight of silver.

24. The process of claim 23 in which said heated gas is nitrogen at a temperature of from about 200° to about 300° C.

25. The process of claim 24 in which said particles have a size of from about 11,000 to about 150 microns.

26. The process of claim 25 in which said particles are contacted with said alkali metal methylate solution at a space velocity of from about 1 to about 60 per hour.

27. The process of claim 26 in which said alkali metal alkoxide is sodium methylate.

* * * * *